US009506654B2

(12) United States Patent
Uhm et al.

(10) Patent No.: US 9,506,654 B2
(45) Date of Patent: Nov. 29, 2016

(54) SYSTEM AND METHOD FOR REDUCING COMBUSTION DYNAMICS IN A COMBUSTOR

(75) Inventors: Jong Ho Uhm, Simpsonville, SC (US); Willy Steve Ziminsky, Simpsonville, SC (US); Thomas Edward Johnson, Greer, SC (US); Shiva Srinivasan, Greer, SC (US); William David York, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1017 days.

(21) Appl. No.: 13/213,460

(22) Filed: Aug. 19, 2011

(65) Prior Publication Data

US 2013/0045450 A1 Feb. 21, 2013

(51) Int. Cl.

| | |
|---|---|
| ***F23C 5/00*** | (2006.01) |
| ***F23D 5/00*** | (2006.01) |
| ***F02C 1/00*** | (2006.01) |
| ***F23R 3/28*** | (2006.01) |
| ***F23R 3/32*** | (2006.01) |
| ***F23D 14/82*** | (2006.01) |
| ***F23R 3/04*** | (2006.01) |
| ***F23R 3/26*** | (2006.01) |

(52) U.S. Cl.

CPC ..... *F23R 3/286* (2013.01); *F23D 14/82* (2013.01); *F23R 3/045* (2013.01); *F23R 3/26* (2013.01); *F23R 3/32* (2013.01); *F23R 2900/00014* (2013.01)

(58) Field of Classification Search

CPC ..... F23R 3/045; F23R 3/26; F23R 3/32; F23R 3/286; F23D 14/82

USPC ..... 431/8, 198; 60/737, 747, 722, 772

See application file for complete search history.

(56) References Cited

U.S. PATENT DOCUMENTS 3,692,460 A * 9/1972 Morck, Jr. ..... F23D 14/125 431/348

3,771,500 A 11/1973 Shakiba (Continued)

FOREIGN PATENT DOCUMENTS

CN 101876451 A 11/2010

CN 101893243 A 11/2010

(Continued)

OTHER PUBLICATIONS

Co-pending U.S. Appl. No. 12/499,777, filed Jul. 8, 2009.

(Continued)

*Primary Examiner* — William G Corboy

(74) *Attorney, Agent, or Firm* — Dority & Manning, PA

(57) ABSTRACT

A system for reducing combustion dynamics in a combustor includes an end cap that extends radially across the combustor and includes an upstream surface axially separated from a downstream surface. A combustion chamber is downstream of the end cap, and tubes extend from the upstream surface through the downstream surface. Each tube provides fluid communication through the end cap to the combustion chamber. The system further includes means for reducing combustion dynamics in the combustor. A method for reducing combustion dynamics in a combustor includes flowing a working fluid through tubes that extend axially through an end cap that extends radially across the combustor and obstructing at least a portion of the working fluid flowing through a first set of the tubes.

11 Claims, 7 Drawing Sheets

(56) References Cited

U.S. PATENT DOCUMENTS

| | | | | |
|---|---|---|---|---|
| 4,100,733 | A * | 7/1978 | Striebel | F23R 3/286 239/419.3 |
| 4,104,873 | A | 8/1978 | Coffinberry | |
| 4,408,461 | A * | 10/1983 | Bruhwiler et al. | 60/737 |
| 4,412,414 | A | 11/1983 | Novick et al. | |
| 5,104,310 | A | 4/1992 | Saltin | |
| 5,205,120 | A | 4/1993 | Obländer et al. | |
| 5,213,494 | A | 5/1993 | Jeppesen | |
| 5,341,645 | A | 8/1994 | Ansart et al. | |
| 5,439,532 | A | 8/1995 | Fraas | |
| 5,592,819 | A | 1/1997 | Ansart et al. | |
| 5,707,591 | A | 1/1998 | Semedard et al. | |
| 6,098,407 | A | 8/2000 | Korzendorfer et al. | |
| 6,123,542 | A | 9/2000 | Joshi et al. | |
| 6,394,791 | B2 | 5/2002 | Smith et al. | |
| 6,438,961 | B2 | 8/2002 | Tuthill et al. | |
| 6,796,790 | B2 | 9/2004 | Venizelos et al. | |
| 6,983,600 | B1 | 1/2006 | Dinu et al. | |
| 7,003,958 | B2 | 2/2006 | Dinu et al. | |
| 7,007,478 | B2 | 3/2006 | Dinu | |
| 7,631,499 | B2 | 12/2009 | Bland | |
| 7,752,850 | B2 | 7/2010 | Laster et al. | |
| 8,079,218 | B2 | 12/2011 | Widener | |
| 8,381,530 | B2 | 2/2013 | Singh et al. | |
| 2004/0216463 | A1 | 11/2004 | Harris | |
| 2006/0213201 | A1* | 9/2006 | Lupkes et al. | 60/776 |
| 2008/0016876 | A1 | 1/2008 | Colibaba-Evulet et al. | |
| 2008/0304958 | A1 | 12/2008 | Norris et al. | |
| 2009/0297996 | A1 | 12/2009 | Vatsky et al. | |
| 2010/0008179 | A1 | 1/2010 | Lacy et al. | |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0089367 | A1* | 4/2010 | Johnson et al. | 123/470 |
| 2010/0095676 | A1 | 4/2010 | Uhm et al. | |
| 2010/0139280 | A1 | 6/2010 | Lacey et al. | |
| 2010/0186413 | A1 | 7/2010 | Lacey et al. | |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016866 | A1 | 1/2011 | Boardman et al. | |
| 2011/0016871 | A1 | 1/2011 | Kraemer et al. | |
| 2011/0072824 | A1 | 3/2011 | Zuo et al. | |
| 2011/0073684 | A1 | 3/2011 | Johnson et al. | |
| 2011/0083439 | A1 | 4/2011 | Zuo et al. | |
| 2011/0089266 | A1 | 4/2011 | Stoia et al. | |

FOREIGN PATENT DOCUMENTS

| | | |
|---|---|---|
| EP | 2213941 A2 | 8/2010 |
| EP | 2634488 A1 | 9/2013 |

OTHER PUBLICATIONS

Co-pending U.S. Appl. No. 12/877,385, filed Sep. 8, 2010.
Co-pending U.S. Appl. No. 12/877,399, filed Sep. 8, 2010.
Co-pending U.S. Appl. No. 13/020,156, filed Feb. 3, 2011.
Unofficial translation of CN office action issued on Apr. 30, 2015 in relation to corresponding CN application 201210202431.7.
EP Search Report issued on May 11, 2015 in relation to corresponding EP application 12171673.2.

* cited by examiner

SYSTEM AND METHOD FOR REDUCING COMBUSTION DYNAMICS IN A COMBUSTOR

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present invention generally involves a system and method for reducing combustion dynamics in a combustor.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by the nozzles, possibly causing severe damage to the nozzles in a relatively short amount of time. In addition, higher combustion gas temperatures generally increase the disassociation rate of diatomic nitrogen, increasing the production of nitrogen oxides ($NO_X$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, a plurality of premixer tubes may be radially arranged in an end cap to provide fluid communication for the working fluid and fuel through the end cap and into the combustion chamber. Although effective at enabling higher operating temperatures while protecting against flashback or flame holding and controlling undesirable emissions, some fuels and operating conditions produce very high frequencies with high hydrogen fuel composition in the combustor. Increased vibrations in the combustor associated with high frequencies may reduce the useful life of one or more combustor components. Alternately, or in addition, high frequencies of combustion dynamics may produce pressure pulses inside the premixer tubes and/or combustion chamber that affect the stability of the combustion flame, reduce the design margins for flashback or flame holding, and/or increase undesirable emissions. Therefore, a system and method that reduces resonant frequencies in the combustor would be useful to enhancing the thermodynamic efficiency of the combustor, protecting the combustor from catastrophic damage, and/or reducing undesirable emissions over a wide range of combustor operating levels.

BRIEF DESCRIPTION OF THE INVENTION

Aspects and advantages of the invention are set forth below in the following description, or may be obvious from the description, or may be learned through practice of the invention.

One embodiment of the present invention is a system for reducing combustion dynamics in a combustor. The system includes an end cap that extends radially across at least a portion of the combustor, and the end cap includes an upstream surface axially separated from a downstream surface. A combustion chamber is downstream of the end cap, and a plurality of tubes extend from the upstream surface through the downstream surface of the end cap. Each tube provides fluid communication through the end cap to the combustion chamber. The system further includes means for reducing combustion dynamics in the combustor.

Another embodiment of the present invention is a system for reducing combustion dynamics in a combustor that includes an end cap that extends radially across at least a portion of the combustor. The end cap includes an upstream surface axially separated from a downstream surface. A combustion chamber is downstream of the end cap. A plurality of tubes extend from the upstream surface through the downstream surface of the end cap, and each tube provides fluid communication through the end cap to the combustion chamber. A first obstruction extends at least partially across a first set of tubes.

The present invention may also include a method for reducing combustion dynamics in a combustor. The method includes flowing a working fluid through a plurality of tubes that extend axially through an end cap that extends radially across at least a portion of the combustor and obstructing at least a portion of the working fluid flowing through a first set of the plurality of tubes.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
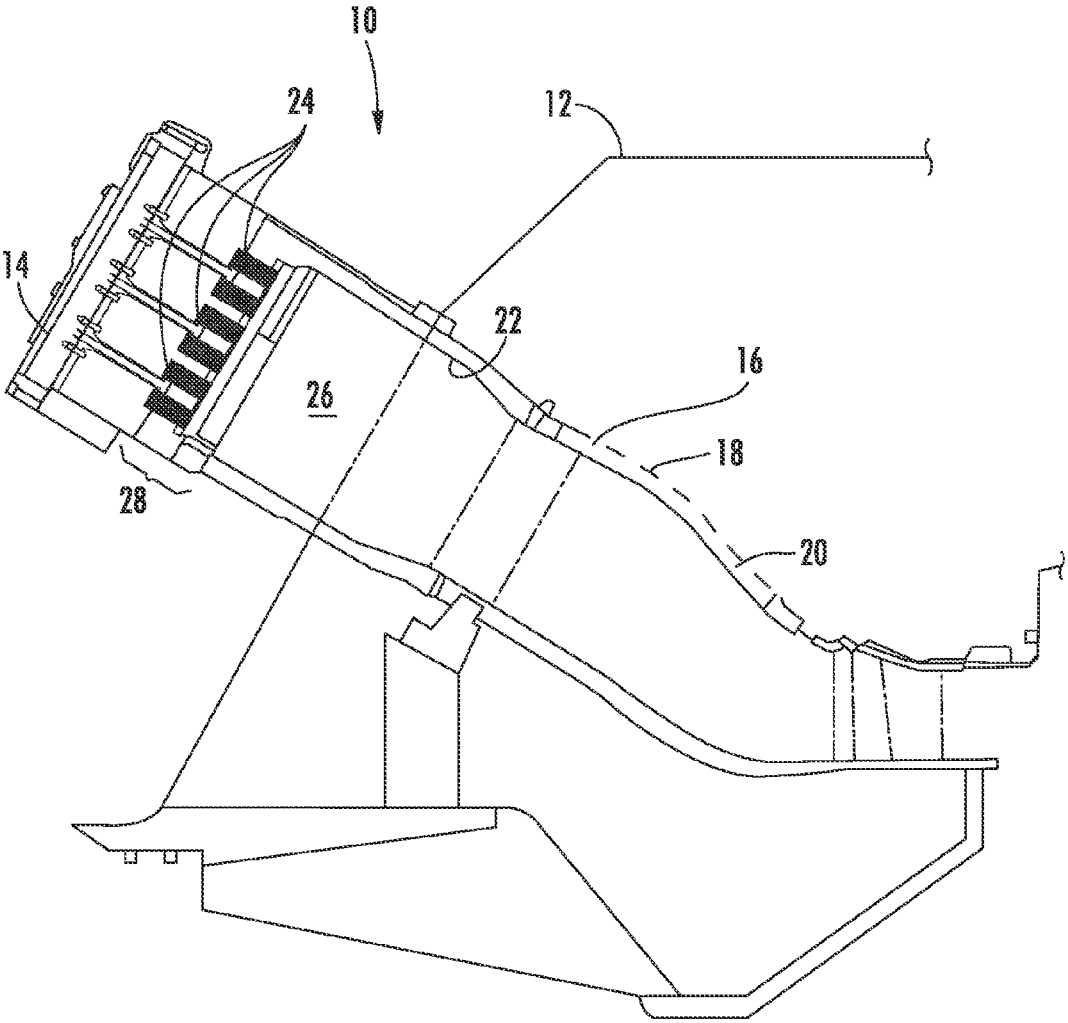
FIG. 1 is a simplified cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for reducing combustion dynamics in a combustor. In particular embodiments, the system and method may set up disturbance areas of combustion dynamics in which a resonant frequency in one or more tubes dampens the frequencies of combustion dynamics excited through surrounding tubes. As a result, various embodiments of the present invention may allow extended combustor operating conditions, extend the life and/or maintenance intervals for various combustor components, maintain adequate design margins of flashback or flame holding, and/or reduce undesirable emissions. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 shows a simplified cross-section of an exemplary combustor 10, such as would be included in a gas turbine, according to one embodiment of the present invention. A casing 12 and end cover 14 may surround the combustor 10 to contain a working fluid flowing to the combustor 10. The working fluid passes through flow holes 16 in an impingement sleeve 18 to flow along the outside of a transition piece 20 and liner 22 to provide convective cooling to the transition piece 20 and liner 22. When the working fluid reaches the end cover 14, the working fluid reverses direction to flow through a plurality of tubes 24 into a combustion chamber 26.

Figure 2:
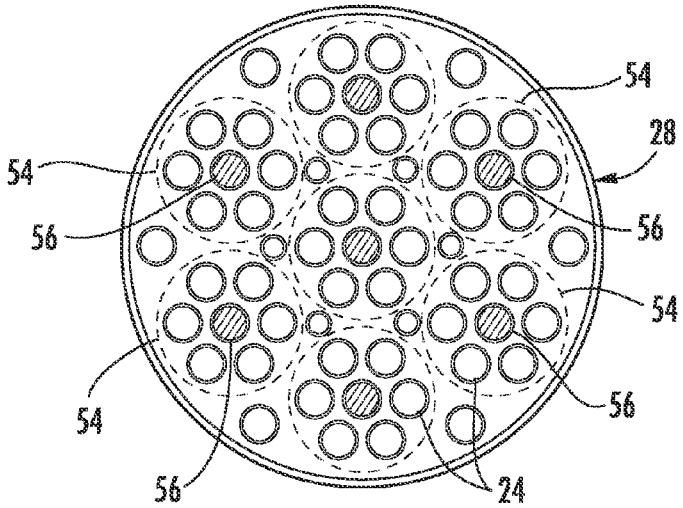
FIG. 2 is an upstream axial view of the end cap shown in FIG. 1 according to an embodiment of the present invention.
Figure 3:
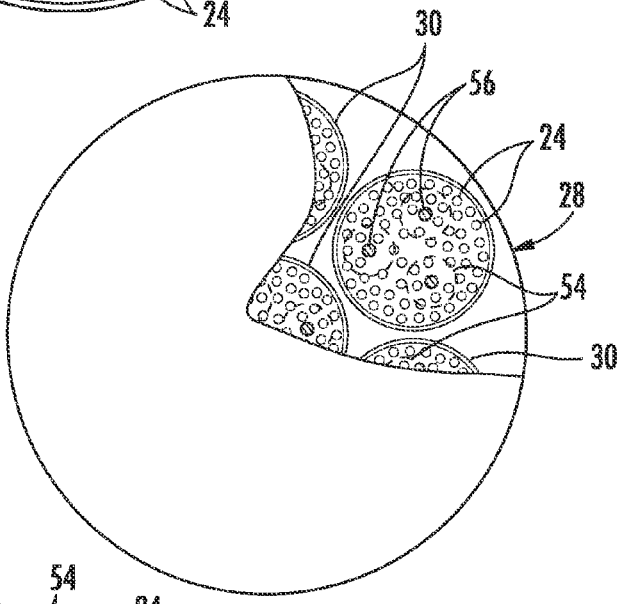
FIG. 3 is an upstream axial view of the end cap shown in FIG. 1 according to an alternate embodiment of the present invention.
Figure 4:
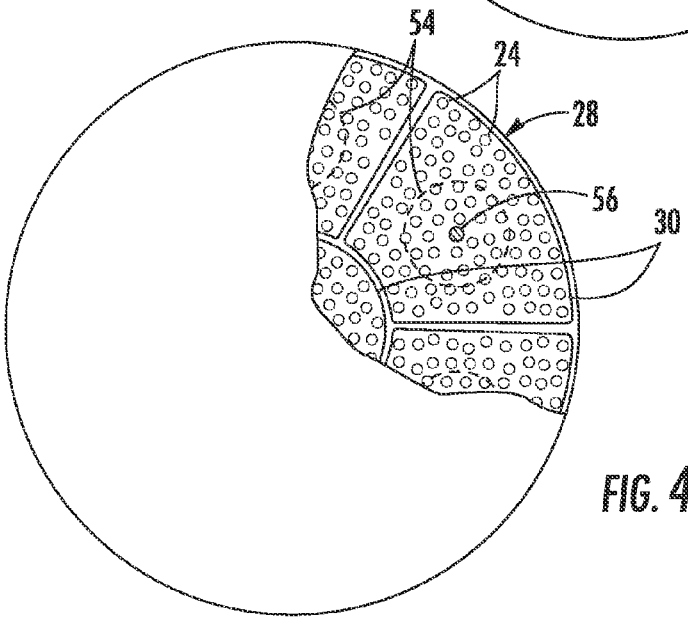
FIG. 4 is an upstream axial view of the end cap shown in FIG. 1 according to an alternate embodiment of the present invention.

The tubes 24 are radially arranged in an end cap 28 upstream from the combustion chamber 26. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A. Various embodiments of the combustor 10 may include different numbers and arrangements of tubes 24, and FIGS. 2, 3, and 4 provide upstream views of various arrangements of tubes 24 in the end cap 28 within the scope of the present invention. As shown in FIG. 2, the tubes 24 may be radially arranged across the entire end cap 28. Alternately, as shown in FIGS. 3 and 4, the tubes 24 may be arranged in circular, triangular, square, oval, or virtually any shape of grouping 30, and the groups 30 of tubes 24 may be arranged in various geometries in the end cap 28. For example, the groups 30 of tubes 24 may be arranged as six groups 30 surrounding a single group 30, as shown in FIG. 3. Alternately, the tubes 24 may be arranged as a series of pie-shaped groups 30 surrounding a circular group 30, as shown in FIG. 4.

FIGS. 5-8 provide enlarged cross-section views of the end cap 28 shown in FIG. 1 according to various embodiments of the present invention. As shown in each figure, the end cap 28 generally extends radially across at least a portion of the combustor 10 and includes an upstream surface 32 axially separated from a downstream surface 34. Each tube 24 includes a tube inlet 36 proximate to the upstream surface 32 and extends through the downstream surface 34 of the end cap 28 to provide fluid communication for the working fluid to flow through the end cap 28 and into the combustion chamber 28. Although shown as cylindrical tubes, the cross-section of the tubes 24 may be any geometric shape, and the present invention is not limited to any particular cross-section unless specifically recited in the claims. A shroud 38 circumferentially surrounds at least a portion of the end cap 28 to partially define a fuel plenum 40 and an air plenum 42 between the upstream and downstream surfaces 32, 34. A generally horizontal barrier 44 may extend radially between the upstream surface 32 and the downstream surface 34 to axially separate the fuel plenum 40 from the air plenum 42. In this manner, the upstream surface 32, shroud 38, and barrier 44 enclose or define the fuel plenum 40 around the upstream portion of the tubes 24, and the downstream surface 34, shroud 38, and barrier 44 enclose or define the air plenum 42 around the downstream portion of the tubes 24.

A fuel conduit 46 may extend from the end cover 14 through the upstream surface 32 of the end cap 28 to provide fluid communication for fuel to flow from the end cover 14, through the fuel conduit 46, and into the fuel plenum 40. One or more of the tubes 24 may include a fuel port 48 that provides fluid communication through the one or more tubes 24 from the fuel plenum 40. The fuel ports 48 may be angled radially, axially, and/or azimuthally to project and/or impart swirl to the fuel flowing through the fuel ports 48 and into the tubes 24. In this manner, the working fluid may flow through the tube inlets 36 and into the tubes 24, and fuel from the fuel plenum 40 may flow through the fuel ports 48 and into the tubes 24 to mix with the working fluid. The fuel-working fluid mixture may then flow through the tubes 24 and into the combustion chamber 28.

The shroud 38 may include a plurality of air ports 50 that provide fluid communication for the working fluid to flow through the shroud 38 and into the air plenum 42. In particular embodiments, a gap 52 between one or more tubes 24 and the downstream surface 34 may provide fluid communication from the air plenum 42, through the downstream surface 34, and into the combustion chamber 28. In this manner, a portion of the working fluid may flow through the air ports 50 in the shroud 38 and into the air plenum 42 to provide convective cooling around the lower portion of the tubes 24 before flowing through the gaps 52 and into the combustion chamber 28.

Each embodiment of the combustor 10 further includes means for reducing combustion dynamics excited through the tubes 24. Referring back to FIG. 2, the means for reducing combustion dynamics excited through the tubes 24 may set up one or more disturbance areas 54 of combustion dynamics in which a resonant frequency in a first set of tubes 56 may dampen or reduce the combustion dynamics excited through surrounding tubes 24. In particular embodiments, the means for reducing combustion dynamics excited through the tubes 24 may comprise an obstruction or fluid boundary that extends at least partially across the first set of tubes 56 at various axial positions. The obstruction or fluid boundary may comprise a flat structure that is substantially parallel to the upstream surface 32. Alternately, or in addition, the obstruction or fluid boundary may comprise a curved surface that extends upstream from the upstream surface 32, effectively extending the length of the tube 24. In other particular embodiments, the obstruction may comprise a perforated plate that extends at least partially across the first set of tubes 56 at various axial positions, and/or the inner diameter of the first set of tubes 56 may vary to dampen the resonant frequencies in the surrounding tubes 24.

Figure 5:
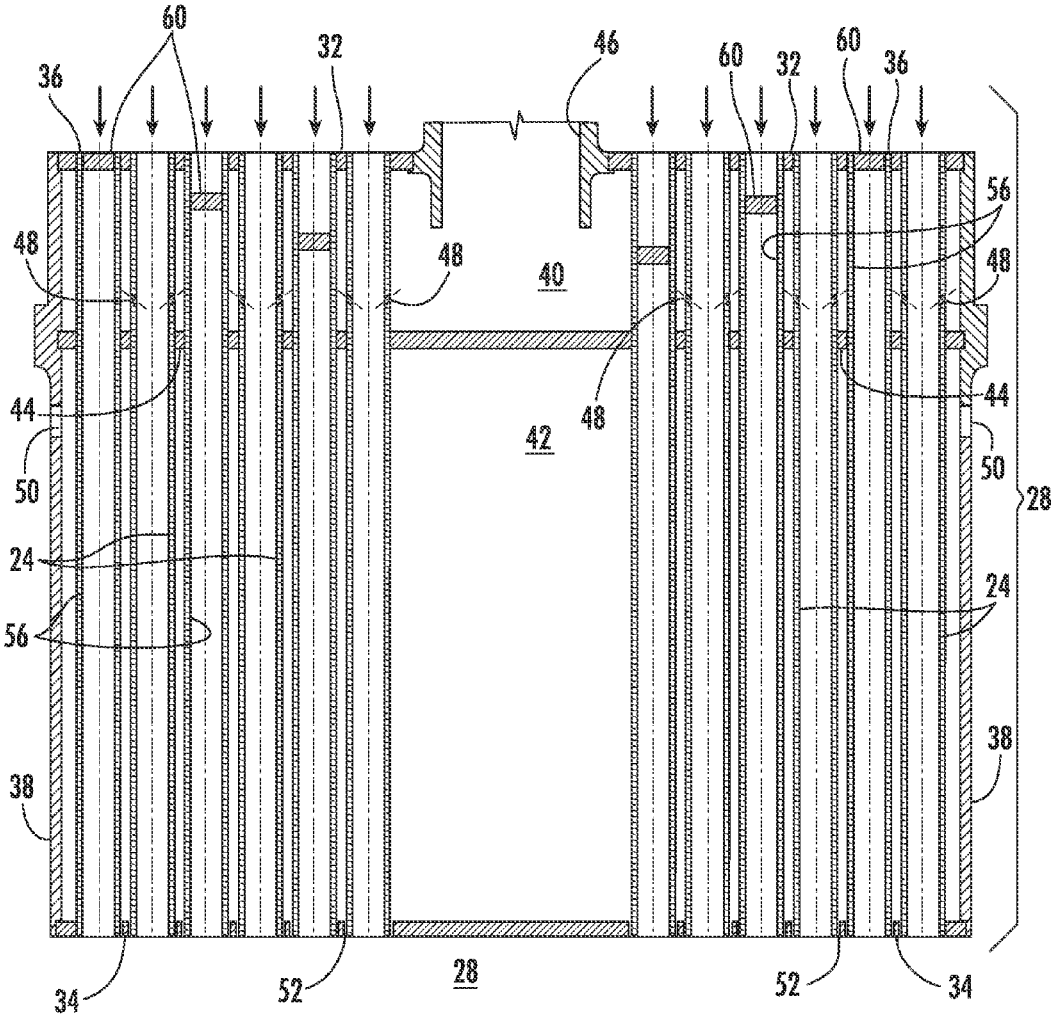
FIG. 5 is an enlarged cross-section view of the end cap shown in FIG. 1 according to a first embodiment of the present invention.

As illustrated in the particular embodiment shown in FIG. 5, the means for reducing combustion dynamics excited through the tubes 24 may comprise a fluid boundary 60 that extends across the first set of tubes 56. The fluid boundary 60 may be substantially parallel to the upstream surface 32 and may extend across the inlet 36 of the first set of tubes 56. Alternately, the fluid boundary 60 may be located at various axial locations inside the first set of tubes 56 to vary the resonant frequency created in the first set of tubes 56. In this manner, the fluid boundary 60 prevents or obstructs the working fluid from flowing through the first set of tubes 56, thus changing the resonant frequency in the first set of tubes 56. The new resonant frequency in the first set of tubes 56 in turn dampens or reduces combustion dynamics excited through the adjacent tubes 24, creating the disturbance area 54 around the first set of tubes 56 shown most clearly in FIG. 2.

Figure 6:
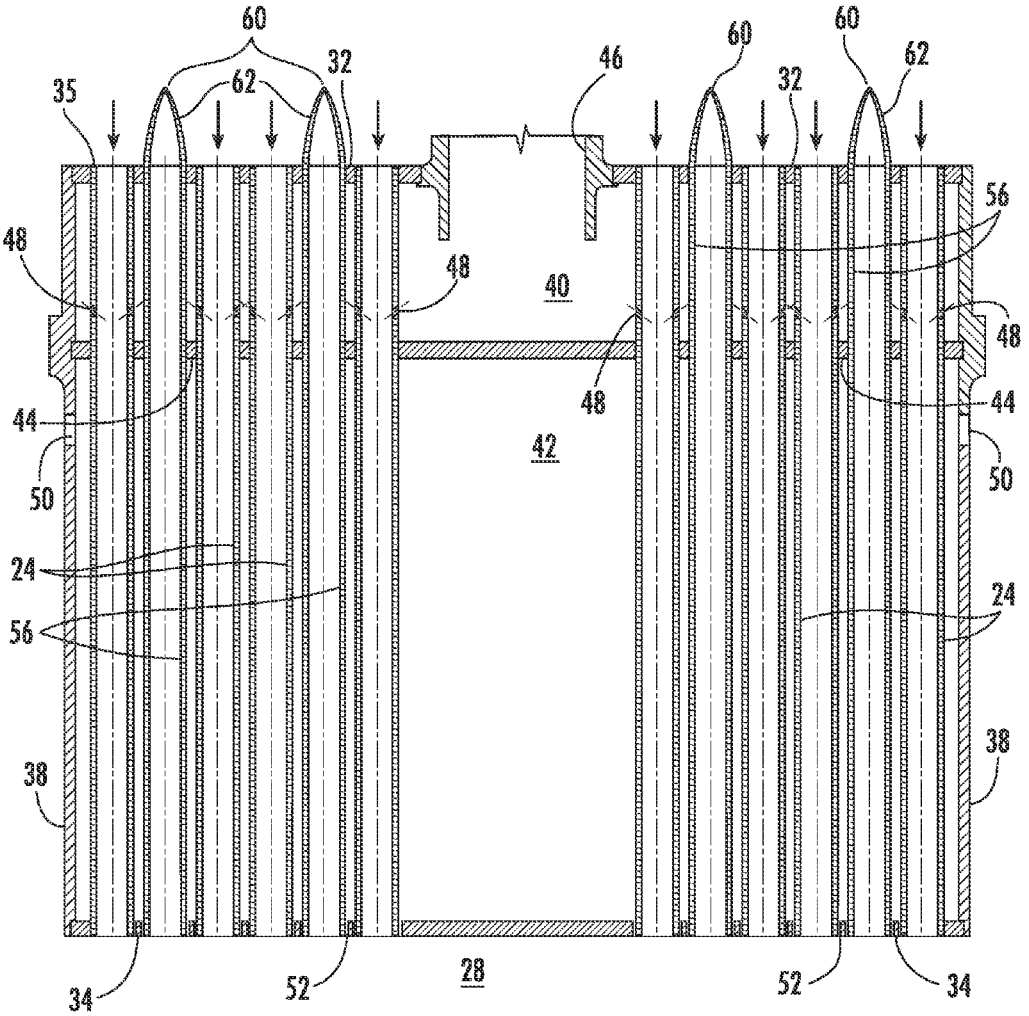
FIG. 6 is an enlarged cross-section view of the end cap shown in FIG. 1 according to a second embodiment of the present invention.

In the embodiment shown in FIG. 6, the fluid boundary 60 again provides the structure for reducing combustion dynamics excited through the tubes 24. In this particular embodiment, however, the fluid boundary 60 comprises a curved surface 62 that extends upstream from the upstream surface 32 proximate to the first set of tubes 56. In this manner, the curved surface 62 of the fluid boundary 60 directs or guides the working fluid away from the first set of tubes 56, reducing any disturbance to working fluid flowing into and through the adjacent or surrounding tubes 24. As with the previous embodiment shown in FIG. 5, the fluid boundary 60 prevents or obstructs the working fluid from flowing through the first set of tubes 56 to change the resonant frequency in the first set of tubes 56. In addition, the fluid boundary 60 extends the length of the first set of tubes 56 to further change the resonant frequency in the first set of tubes 56. The new resonant frequency in the first set of tubes 56 in turn dampens or reduces combustion dynamics excited through the adjacent tubes 24, creating the disturbance area 54 of combustion dynamics around the first set of tubes 56.

Figure 7:
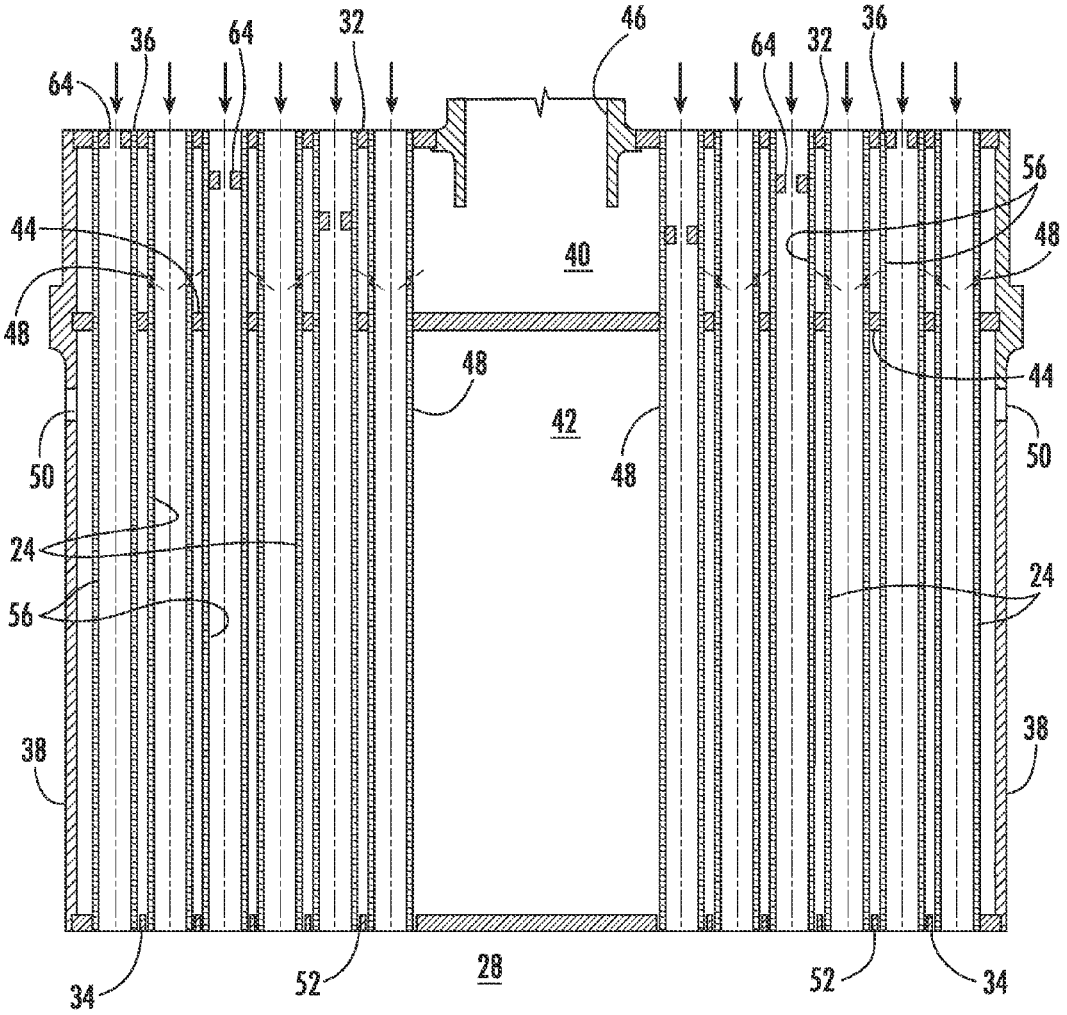
FIG. 7 is an enlarged cross-section view of the end cap shown in FIG. 1 according to a third embodiment of the present invention.

In the embodiment shown in FIG. 7, the means for reducing combustion dynamics excited through the tubes 24 again comprises an obstruction at the inlet 36 or at various axial locations inside the first set of tubes 56. However, in this particular embodiment, the obstruction comprises a perforated plate 64 that extends at least partially across the first set of tubes 56. The perforated plate 64 may have one or more holes that allow a reduced amount of working fluid to flow through the first set of tubes 56. In addition, the fuel ports 48, if present in the first set of tubes 56, may be slightly reduced in size to reduce the amount of fuel flowing from the fuel plenum 40 into the first set of tubes 56. The reduced flow of working fluid and/or fuel through the first set of tubes 56 changes the resonant frequency in the first set of tubes 56, causing a corresponding dampening or reduction in combustion dynamics excited through the tubes 24.

Figure 8:
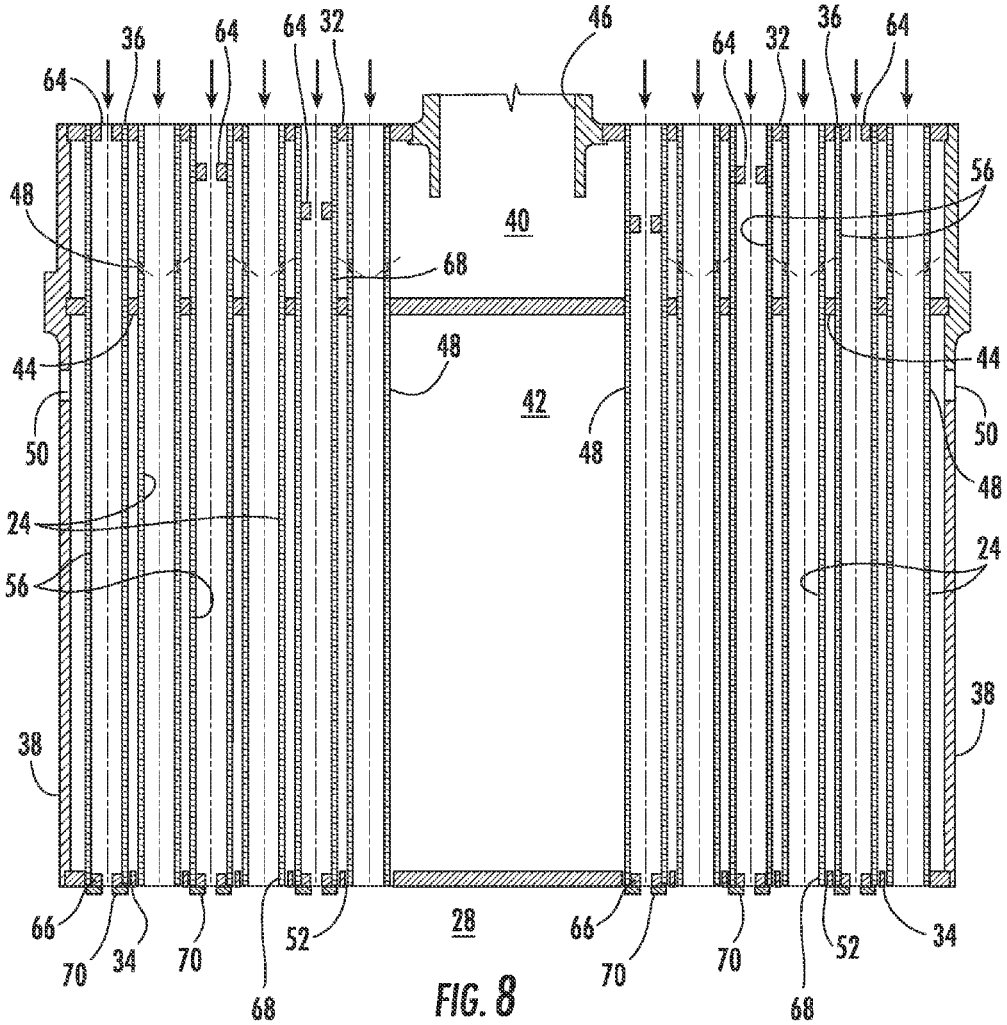
FIG. 8 is an enlarged cross-section view of the end cap shown in FIG. 1 according to a fourth embodiment of the present invention.

In the embodiment shown in FIG. 8, the perforated plate 64 again provides the structure for reducing combustion dynamics excited through the tubes 24. In this particular embodiment, the combustor 10 further includes a second perforated plate 66 that extends across and is proximate to an outlet 68 of one or more of the first set of tubes 56. The resulting combination of the first and second perforated plates 64, 66 effectively forms a Helmholtz resonator in the first set of tubes 56 to change the resonant frequency in the first set of tubes 56, thus creating the disturbance area 54 of combustion dynamics. In particular embodiments, a thermal barrier coating 70 may be applied to the second perforated plate 66 and/or downstream surface 34 to provide additional protection against excessive temperatures from the combustion chamber 28.

Figure 9:
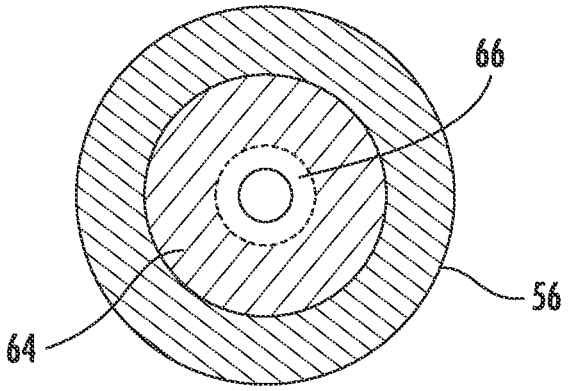
FIG. 9 is an axial view of a tube shown in FIG. 8 according to one embodiment of the present invention.
Figure 10:
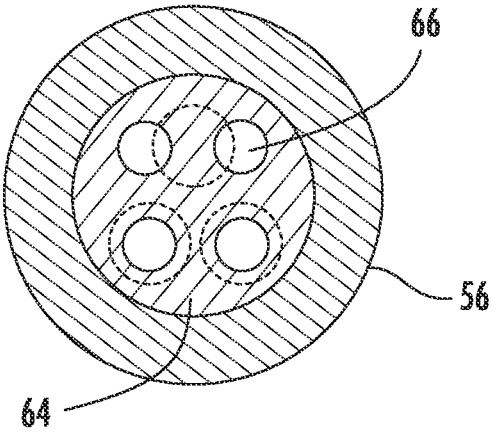
FIG. 10 is an axial view of a tube shown in FIG. 8 according to an alternate embodiment of the present invention.

FIGS. 9 and 10 provide axial views of an exemplary tube in the first set of tubes 56 shown in FIG. 8 according to alternate embodiments of the present invention. As shown in FIG. 9, the first and second perforated plates 64, 66 may be substantially aligned so that the respective holes or perforations in each perforated plate 64, 66 are aligned with one another. In contrast, the first and second perforated plates 64, 66 shown in FIG. 10 are not substantially aligned. The alignment or non-alignment of the first and second perforated plates 64, 66 in the first set of tubes 56 may allow further adjustment of the resonant frequency in the first set of tubes 56.

The various embodiments described and illustrated with respect to FIGS. 1-10 may also provide a method for reducing combustion dynamics in the combustor 10. The method generally includes flowing the working fluid through and obstructing at least a portion of the working fluid flowing through the first set of tubes 56. The obstructing may comprise preventing or reducing the working fluid from flowing into the first set of tubes 56. The method may further include directing the working fluid away from the first set of tubes 56 and/or obstructing at least a portion of the working fluid flowing out of the first set of tubes 56.

The systems and methods described herein may provide one or more of the following advantages over existing nozzles and combustors. For example, the creation of disturbance areas 54 of combustion dynamics in the combustor may extend the operating capability of the combustor 10 over a wide range of fuels without decreasing the useful life and/or maintenance intervals for various combustor 10 components. Alternately, or in addition, the reduced resonant frequencies in the combustor 10 may maintain or increase the design margin against flashback or flame holding and/or reduce undesirable emissions over a wide range of combustor 10 operating levels. In addition, the obstructions, fluid boundaries 60, and/or perforated plates 64, 66 described herein may be installed in existing combustors 10, providing a relatively inexpensive modification of existing combustors 10 that reduces resonance frequencies.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A system for reducing combustion dynamics in a combustor, comprising:

an end cap having an upstream surface, a horizontal barrier axially spaced from the upstream surface, a downstream surface axially spaced from the horizontal barrier and a shroud circumferentially surrounding the upstream surface, the horizontal barrier and the downstream surface, wherein the upstream surface and the horizontal barrier define a fuel plenum therein;

a fluid conduit providing for fluid communication into the fuel plenum;

a combustion chamber downstream of the downstream surface; and a plurality of tubes that extend through the upstream surface, the horizontal barrier and the downstream surface of the end cap, each tube having a fuel port defined between the upstream surface and the horizontal barrier, each fuel port being in fluid communication with the fuel plenum, wherein each tube provides fluid communication through the end cap to the combustion chamber;

wherein at least one tube of the plurality of tubes includes a first flow obstruction and a second flow obstruction disposed therein, wherein the first flow obstruction is positioned downstream from an inlet of the at least one tube and upstream from the fuel port of the at least one tube and wherein the second flow obstruction is disposed downstream from the fuel port; wherein the first flow obstruction comprises a first perforated plate defining a first hole, wherein the second flow obstruction comprises a second perforated plate defining a second hole, and wherein the first hole of the first perforated plate and the second hole of the second perforated plate are radially offset from each other with respect to an axial centerline of the at least one tube.

2. The system as in claim 1, wherein the first flow obstruction is disposed within the at least one tube proximate to the upstream surface.

3. The system as in claim 1, wherein the horizontal barrier, the downstream surface and the shroud at least partially define an air plenum.

4. A system for reducing combustion dynamics in a combustor, comprising:

an end cap having an upstream surface, a horizontal barrier axially spaced from the upstream surface, a downstream surface axially spaced from the horizontal barrier and a shroud circumferentially surrounding the upstream surface, the horizontal barrier and the downstream surface, wherein the upstream surface and the horizontal barrier define a fuel plenum therein;

a fluid conduit providing for fluid communication into the fuel plenum; and a plurality of tubes that extend through the upstream surface, the horizontal barrier and the downstream surface of the end cap, each tube having a fuel port defined between the upstream surface and the horizontal barrier, wherein the plurality of tubes comprises a first tube and a second tube;

wherein the first tube comprises a first fuel port defined between the upstream surface and the horizontal barrier, a first flow obstruction and a second flow obstruction, wherein the first flow obstruction of the first tube is disposed within the first tube downstream from an inlet to the first tube and upstream from the first fuel port, wherein the second flow obstruction of the first tube is disposed downstream from the fuel port, wherein the first fuel port is in fluid communication with the fuel plenum; and wherein the second tube comprises a second fuel port defined between the upstream surface and the horizontal barrier, a first flow obstruction and a second flow obstruction disposed within the second tube downstream from an inlet to the second tube, wherein the first flow obstruction of the second tube is disposed upstream from the second fuel port, wherein the second flow obstruction of the second tube is disposed downstream from the fuel port, wherein the second fuel port is in fluid communication with the fuel plenum; wherein the first flow obstruction of the first tube comprises a first perforated plate defining a first hole, wherein the second flow obstruction of the first tube comprises a second perforated plate disposed within the first tube downstream from the first perforated plate and defining a second hole, and wherein the first hole of the first perforated plate and the second hole of the second perforated plate of the first tube are radially offset from each other with respect to an axial centerline of the first tube.

5. The system as in claim 4, wherein the first flow obstruction of the first tube is disposed within the first tube proximate to the upstream surface.

6. The system as in claim 4, wherein the first flow obstruction of the second tube is disposed within the second tube proximate to the upstream surface.

7. The system as in claim 4, wherein the first flow obstruction of the second tube comprises a first perforated plate defining a first hole and wherein the second flow obstruction of the second tube comprises a second perforated plate defining a second hole.

8. The system as in claim 7, wherein the second perforated plate is disposed downstream from the first perforated plate of the second tube proximate to the downstream surface.

9. The system as in claim 8, wherein the first hole of the first perforated plate and the second hole of the second perforated plate of the second tube are radially offset from each other with respect to an axial centerline of the second tube.

10. The system as in claim 4, wherein the downstream surface, the horizontal barrier and the shroud at least partially define an air plenum.

11. A method for reducing combustion dynamics in a combustor, comprising:

flowing a working fluid through a plurality of tubes that extend axially through an end cap that extends radially across at least a portion of the combustor, wherein each tube includes a fuel port disposed axially between an upstream surface and a horizontal barrier of the end cap, each fuel port in fluid communication with a common fuel plenum; and obstructing at least a portion of the working fluid flowing through a first tube of the plurality of tubes via a first perforated plate defining a first hole and disposed within the first tube upstream from the respective fuel ports of the first tube and via a second perforated plate defining a second hole and disposed within the first tube downstream from the first perforated plate; wherein the obstructing comprises preventing the working fluid from flowing into one or more tubes of the plurality of tubes and wherein the first hole of the first perforated plate and the second hole of the second perforated plate are radially offset with regards to an axial centerline of the first tube of the plurality of tubes.

* * * * *